US005169020A

United States Patent [19]

Spamer

[11] Patent Number: 5,169,020

[45] Date of Patent: Dec. 8, 1992

[54] MERCHANDISING DISPLAY FOR POINT OF PURCHASE COOLED ITEMS

[75] Inventor: William S. Spamer, Roswell, Ga.

[73] Assignee: The Mead Corporation, Dayton, Ohio

[21] Appl. No.: 831,867

[22] Filed: Feb. 5, 1992

[51] Int. Cl.[5] ..... B65D 69/00

[52] U.S. Cl. ..... 220/444; 220/287; 206/223; 62/463

[58] Field of Search ..... 220/444, 412, 413, 287; 206/545, 223; 62/463, 464

[56] References Cited

U.S. PATENT DOCUMENTS 3,818,180 6/1974 Akosio ..... 220/545
4,042,142 8/1977 Ruano ..... 220/DIG. 6
4,360,105 11/1982 Williams ..... 206/545
4,630,671 12/1986 Sherman et al. ..... 206/545
4,899,904 2/1990 Dooley et al. ..... 206/545
4,982,840 1/1991 Bidwell et al. ..... 206/223
5,048,171 9/1991 Bidwell et al. ..... 29/401

*Primary Examiner*—Joseph Man-Fu Moy
*Attorney, Agent, or Firm*—Rodgers & Rodgers

[57] ABSTRACT

An open top barrel having an end portion of circular configuration includes a linear tub somewhat smaller than the barrel and disposed within the barrel together with a bezel flange formed integrally with the liner and in engagement with the barrel end portion, the bezel flange being formed to mate with a range of different barrel end portion sizes.

7 Claims, 2 Drawing Sheets

MERCHANDISING DISPLAY FOR POINT OF PURCHASE COOLED ITEMS

TECHNICAL FIELD

This invention is concerned with merchandising point of purchase items such as soft drinks, beer and the like.

BACKGROUND ART

U.S. Pat. Nos. 4,982,840 issued Jan. 8, 1991 and 5,048,171 issued Sep. 17, 1991 disclose a method primarily for converting used molded plastic barrels employed in the soft drink beverage industry for holding and transporting soft drink concentrates and syrups into free standing merchandising display units.

BEST MODE OF CARRYING OUT THE INVENTION

Figure 1:
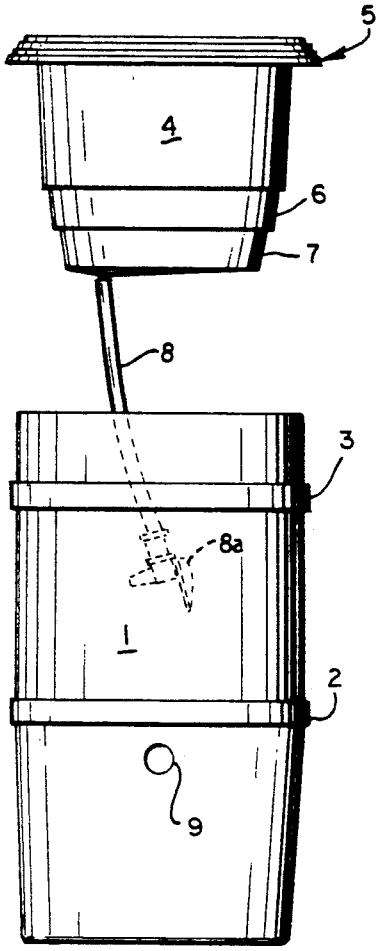
FIG. 1 is a side view of a display unit shown in partially assembled condition.
Figure 7:
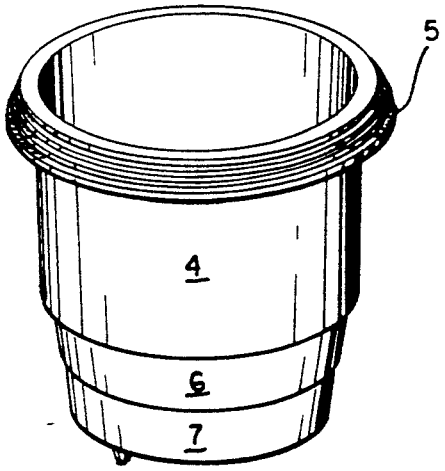
FIG. 7 is a perspective view of a tub liner and bezel formed according to this invention.

With reference to FIG. 1, a barrel is shown which is suitable for use in conjunction with this invention. The barrel 1 has a bottom la includes a pair of bands 2 and 3. The bands 2 and 3 are not used on all barrels and are infrequently used if the barrel constitutes a fiber drum. A liner tub 4 (FIG. 7) includes an annular bezel 5 formed about its upper surface and may include a series of step down diameters 6 and 7 and the like together with a discharge tube 8 which is inserted through the outlet port 9 formed in the side of barrel 1 for conveying melted ice to a disposed vessel not shown.

Figure 8:
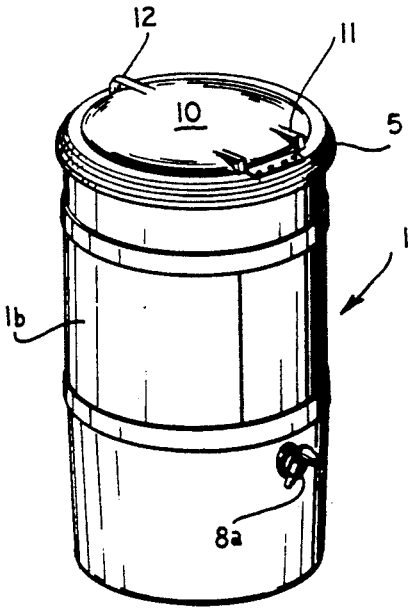
FIG. 8 is a perspective view of an assembled unit and which includes a cover.

If desired, a top closure 10 best shown in FIG. 8 may be provided and may include conventional hinge structure 11 mounted on bezel 5 and a handle 12 of any suitable known type. If desired the closure 10 may be formed on clear translucent material to afford a view of the liner tub contents.

Figure 2:
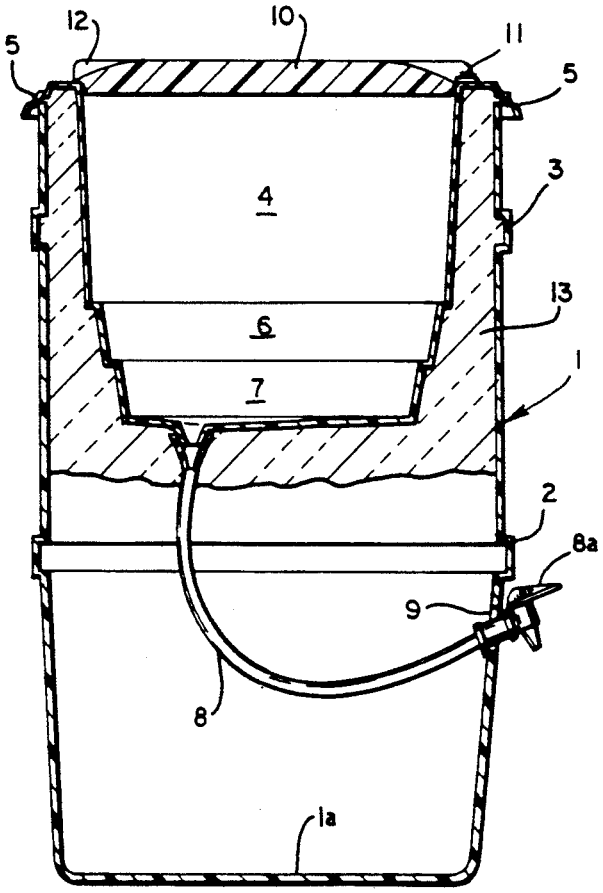
FIG. 2 is a cross sectional view of a device such as is shown in FIG. 1 but which is completely assembled.
Figure 6:
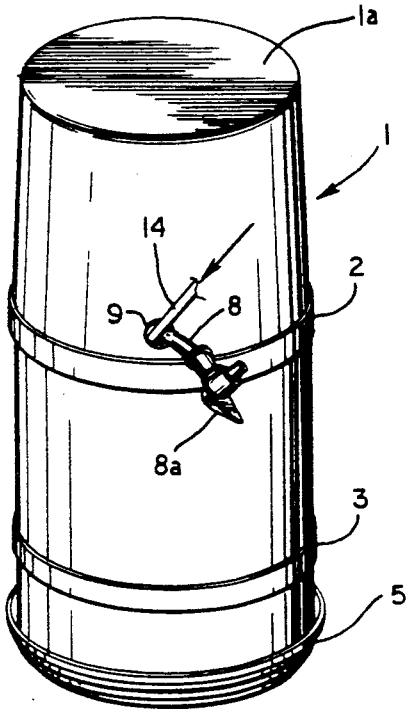
FIG. 6 is a view of a display unit shown in an upside down condition.

For the purpose of securing the liner tub 4 in position within the barrel 1, suitable foam material 13 may be supplied into the barrel 1 in such manner as to surround the liner tub 4. This material as is shown in FIG. 6 may be inserted as indicated by arrow 20 in port 9 through the tube 14 in port 9 and into the space disposed about the liner tub 4 as indicated in FIG. 2. This foam material is supplied while in a fluid state and preferably may comprise polyurethane foam. Of course this foam material 13 when it hardens secures the liner tub in position and also insulates the liner tub 4 from ambient conditions. The barrel as shown in FIG. 2 is depicted in FIG. 6 in upside down condition so as to utilize the force of gravity to cause the foam 13 to settle about the liner tub as shown in FIG. 2.

Before inserting the foam in fluid state through the inlet tube 14 and the aperture 9, the nozzle 8*a* and a portion of the tube 8 must be inserted through the opening 9 so as to avoid interference with the tube 8 by the fluid foam.

Figure 3:
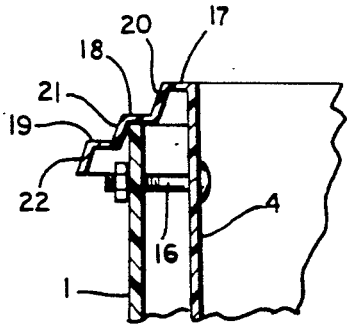
FIG. 3 discloses a bezel flange adaptable for use in connection with the devices shown in FIGS. 1 and 2.
Figure 4:
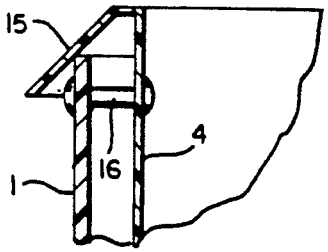
FIG. 4 is a detailed cross section of structure similar to FIG. 3.
Figure 5:
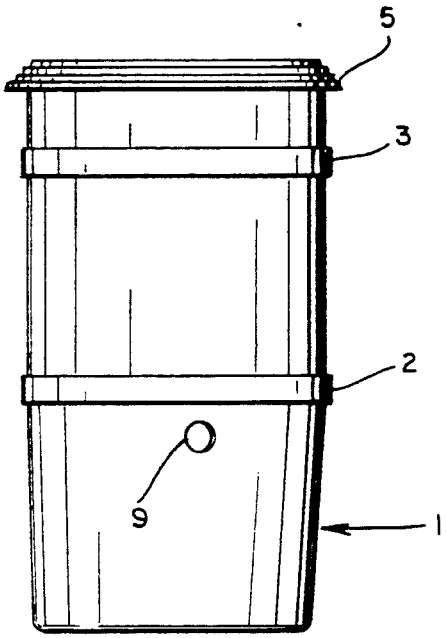
FIG. 5 is an exterior assembled view of a display unit formed according to this invention.

In order to adapt a liner tub such as 4 to a barrel such as 1 either of which may vary in size, the bezel structure shown in FIGS. 3 and 4 is employed in accordance with a feature of this invention. The bevelled bezel structure 15 obviously is adaptable for use in conjunction with barrel structures which may vary in size. Furthermore, if desired, the liner tub 4 may be interconnected with the wall of barrel 1 by suitable mechanical or adhesive means such as are indicated at 16. As is clear from FIG. 4, the bolts 16 are hidden from view by the annular bezel 15. This structure could be used instead of the fluidized foam supplied through tube 14 from a source indicated by the arrow 20 in FIG. 6.

Instead of the simplified bezel flange 15 shown in FIG. 4, the bezel structure shown in FIG. 3 and having ring like structures such as 17, 18 and 19 may be employed for selective engagement with the top surface of the barrel 1 so as to accommodate different sizes of barrels. The ringlike structure 17, 18 and 19 are substantially perpendicular to the end portion of the barrel and are interconnected by ringlike annular structures 20, 21 and 22. Thus a particular bezel arrangement such as shown in either FIGS. 3 or 4 may be constructed so as to accommodate a range of barrel sizes.

Instead of inverting the structure as shown in FIG. 6 for receiving fluid foam, a liner tub may be encompassed by an insulating mechanically strong structure preformed and then inserted simultaneously into the barrel 1. The structure could be secured by mechanical or adhesive means such as 16 shown in FIGS. 3 and 4.

Of course the nozzle 8*a* and its associated tube 8 and funnel 8*b* are used to dispose of melted ice which accumulates over a period of time in the liner tub 4. Toward this end, a container of some sort which is not shown in the drawing may be used to receive the liquid which flows through the tube 8 and nozzle 8*a* for disposition.

If desired, suitable known dollies may be mounted underneath the barrel so as to facilitate moving the display from place to place. Also, suitable advertising material may be applied to the outside of the barrel 1 as indicated at 1*b* in FIG. 8.

In accordance with this invention, it is clear that used barrels such as that indicated at 1 or new barrels may be employed in connection with this invention. Also by the employment of the bezel structure, one flange size of bezel structure adapts the arrangement to a plurality of barrel sizes and to a plurality of liner tubs thus effecting substantial economies in the use of material and storage space. Also, the foam material such as is indicated by the numeral 13 when hardened effects an efficient insulating operation to maintain the contents of the liner tub at a desired temperature and aids in securing the liner tub 4 in position in the barrel 1.

I claim:

1. A merchandising display comprising a barrel having an end portion of circular configuration, a liner tub somewhat smaller than said barrel and disposed within said barrel, a bezel flange formed integrally with said liner tub and in engagement with said end portion of said barrel, said bezel flange being formed to mate with a range of different barrel end portion sizes, and a heat insulating foam in a fluid state which is forced into the space between said barrel and said liner tub and which hardens to secure said liner tub in place within said barrel and to insulate the liner tub from ambient conditions.

2. A merchandising display according to claim 1 wherein said heat insulating foam comprises polyurethane foam.

3. A merchandising display according to claim 1 wherein said bezel flange is of bevelled disposition and arranged in angular relation to said end portion of said barrel.

4. A merchandising display according to claim 1 wherein said bezel flange comprises a plurality of spaced ring like surfaces of different diameters and which are selectively engageable with said end portion of said barrel.

5. A merchandising display according to claim 4 wherein said spaced ring like surfaces are disposed in imaginary planes which are substantially perpendicular to said end portion of said barrel.

6. A merchandising display according to claim 4 wherein said spaced ring like surfaces are interconnected by ring like bevelled surfaces interposed between and integrally formed with said spaced ring like surfaces.

7. A merchandising display according to claim 1 wherein conventional mechanical or adhesive means may be employed to secure the liner tub and an encompassing jacket of insulating material into said barrel.

* * * * *